US011691053B2

(12) United States Patent
Miao

(10) Patent No.: US 11,691,053 B2
(45) Date of Patent: Jul. 4, 2023

(54) APPARATUS FOR SECURELY CONNECTING A GOLF CLUB SHAFT AND A CLUB HEAD

(71) Applicant: Chunxi Miao, Shenzhen (CN)

(72) Inventor: Chunxi Miao, Shenzhen (CN)

( * ) Notice: Subject to any disclaimer, the term of this patent is extended or adjusted under 35 U.S.C. 154(b) by 84 days.

(21) Appl. No.: 17/183,707

(22) Filed: Feb. 24, 2021

(65) Prior Publication Data

US 2022/0266097 A1 Aug. 25, 2022

(51) Int. Cl.
*A63B 53/02* (2015.01)
*A63B 60/00* (2015.01)

(52) U.S. Cl.
CPC ..... *A63B 53/02* (2013.01); *A63B 60/00* (2015.10)

(58) Field of Classification Search
CPC ..... A63B 53/02
USPC ..... 473/305–315
See application file for complete search history.

(56) References Cited

U.S. PATENT DOCUMENTS 5,931,742 A * 8/1999 Nishimura ..... A63B 53/02 473/305
6,558,269 B1 * 5/2003 McBee ..... A63B 60/00 473/340
7,115,046 B1 * 10/2006 Evans ..... A63B 53/0466 473/307
8,142,307 B2 * 3/2012 Sanchez ..... A63B 53/02 473/307
8,641,554 B1 * 2/2014 Hocknell ..... A63B 53/02 473/307
2006/0105855 A1 * 5/2006 Cackett ..... A63B 53/02 473/306
2007/0004527 A1 * 1/2007 Helmstetter ..... A63B 60/00 473/282
2007/0004528 A1 * 1/2007 Hocknell ..... A63B 53/02 473/305
2007/0173344 A1 * 7/2007 Burch ..... A63B 53/02 473/307
2008/0254909 A1 * 10/2008 Callinan ..... A63B 53/02 473/305
2009/0011848 A1 * 1/2009 Thomas ..... A63B 60/00 473/307

(Continued)

FOREIGN PATENT DOCUMENTS

KR 20010098600 A * 11/2001
KR 20110046468 A * 5/2011

(Continued)

*Primary Examiner* — Alvin A Hunter

(57) ABSTRACT

A golf club connecting apparatus for securely connecting a golf club shaft and a club head having a hosel portion is disclosed. The apparatus could be advantageously employed with various types of golf clubs. The apparatus comprises a hosel adapter, a shaft adapter, and at least one fastener, for example, a nut. The hosel adapter is configured to insert into the hosel portion such that the hosel adapter is positioned within the cylindrical sleeve of the hosel portion. The shaft adapter is securely affixed to the terminal end of the golf club shaft, wherein the shaft adapter is configured to insert into the hosel adapter via a longitudinal bore. The fastener is configured to threadably engage to the hosel adapter via the plurality of threads, thereby securing the club head and the golf club shaft together by inserting the shaft adapter into the hosel adapter.

11 Claims, 5 Drawing Sheets

(56) References Cited

U.S. PATENT DOCUMENTS

2009/0011849 A1* 1/2009 Thomas ..... A63B 60/00 473/307
2009/0011850 A1* 1/2009 Stites ..... A63B 60/00 473/305
2009/0062029 A1* 3/2009 Stites ..... A63B 53/02 473/307
2009/0075748 A1* 3/2009 Evans ..... A63B 53/02 473/306
2010/0035700 A1* 2/2010 Yu ..... A63B 60/54 473/307
2010/0035701 A1* 2/2010 Kusumoto ..... A63B 53/02 473/307
2010/0041491 A1* 2/2010 Thomas ..... A63B 53/02 473/316
2011/0111881 A1* 5/2011 Sander ..... A63B 53/02 473/307
2012/0100926 A1* 4/2012 Golden ..... A63B 53/0466 473/307
2012/0142446 A1* 6/2012 Evans ..... A63B 53/02 473/307
2012/0190474 A1* 7/2012 Sato ..... A63B 53/06 473/409
2012/0225729 A1* 9/2012 Burch ..... A63B 60/00 473/307
2013/0288816 A1* 10/2013 Nakamura ..... A63B 53/02 473/309
2014/0051527 A1* 2/2014 Sato ..... A63B 53/02 473/307
2014/0213386 A1* 7/2014 Yamamoto ..... A63B 53/00 473/307
2014/0248973 A1* 9/2014 Murphy ..... A63B 53/047 473/307
2018/0185710 A1* 7/2018 Mizutani ..... A63B 53/02
2022/0226701 A1* 7/2022 Tachibana ..... A63B 53/06

FOREIGN PATENT DOCUMENTS

WO WO-9934882 A1 * 7/1999 ..... A63B 53/02
WO WO-0020075 A1 * 4/2000 ..... A63B 53/02

* cited by examiner

APPARATUS FOR SECURELY CONNECTING A GOLF CLUB SHAFT AND A CLUB HEAD

BACKGROUND OF THE INVENTION

A. Technical Field

The present invention generally relates to an apparatus for securely connecting a golf club shaft and a club head. More specifically, the present invention relates to a golf club connecting apparatus for securely connecting a golf club shaft and a club head having a hosel portion.

B. Description of Related Art

A golf club is used to hit a golf ball in a game of golf. A contemporary golf club has two major components such as a shaft with a grip and a club head. The club head includes a hosel having a bore that receives the tip end of the shaft when the club is assembled. The tip end of the shaft is typically secured in the golf club hosel. Golfers frequently customize their golf clubs to better suit their particular swing during the fitting process. In order to accommodate such customization, various connecting apparatus that releasably mount club heads onto the shafts have been proposed.

The connecting apparatus have been recognized as providing an advantage to club retailers, as golfers could try various combinations of shafts and club heads in a single visit to a retail store. However, these connecting apparatus have significant deficiencies. For example, the portion of the connector that mounts with the hosel of the club head is typically received in the bore of the hosel. This portion of the hosel is ordinarily occupied by the tip end of the shaft alone when a connector is not employed. Such a configuration creates problems such as change in design dynamics of the club and also creates a metallic, mute, or harsh feel when striking a golf ball.

Few existing patent references attempted to address the aforementioned problems are cited in the background as prior art over the presently disclosed subject matter and are explained as follows:

A prior art U.S. Pat. No. 8,046,899 assigned to Eric Burch, describes about a connector for releasably securing a shaft and a head having a hosel with a bore of standard size. The connector includes a shaft adapter, a hosel adapter, and a compression nut. The shaft adapter has a shaft bore sized to receive the shaft, a first threaded coupling member, and an axial shaft. The hosel adapter has a hosel bore and a main body portion. The hosel bore is sized to receive the axial shaft. The compression nut has a second coupling member. The shaft is secured within the shaft bore and the main body portion is secured within the bore of the hosel using an adhesive and the axial shaft is inserted within the hosel bore. Thereafter, the compression nut is rotated to couple the first and second coupling members together thereby securing the shaft and head together without the shaft being received within the bore of the hosel.

Another prior art U.S. Pat. No. 8,562,454 assigned to Eric Burch, describes about a connector of a golf club is provided. The connector includes a shaft adapter and a hosel adapter. A compression nut fits over both adapters to secure them against one another. The hosel adapter advantageously fits over the hosel, thereby allowing the bore of the hosel to remain unmodified from its original design. The connector also includes an anti-rotation arrangement to prevent relative rotation between the shaft adapter and the hosel adapter. Further, the tip end of the club shaft passes entirely through the connector and seats within the hosel as it normally would in the absence of the connector. The connector does not surround the tip end of the shaft where it seats in the hosel, giving the club an unaltered feel, despite the inclusion of the connector.

However, the existing prior arts are limited to solve problems such as change in design dynamics of the club and also create a metallic, mute, or harsh feel when striking a golf ball. In light of the above-mentioned problems, there is a need for an improved connection that provides a method for quickly and easily connecting the golf club shaft to the club head having a hosel. Further, there is also a need for a golf club connecting apparatus for securely connecting the golf club shaft and the club head having a hosel.

SUMMARY OF THE INVENTION

The present invention generally discloses an apparatus for securely connecting a golf club shaft and a club head. Further, the present invention discloses a golf club connecting apparatus for securely connecting a golf club shaft and a club head having a hosel portion.

In one embodiment, the apparatus is configured to enable a user to securely connect the golf club shaft to the hosel portion of the golf club. In one embodiment, the apparatus could be advantageously employed with various types of golf clubs. In one embodiment, the apparatus is configured to make a quick switch to combine/assemble different shafts and different clubs head, for a golfer to try if that setup is suitable for him. The switching could perform again and again without any damage and pull job and no extra glue is required. In one embodiment, the apparatus is securely affixed between the golf club shaft to the hosel portion of the golf club without any modification of either of these components. In one embodiment, the apparatus comprises a hosel adapter, a shaft adapter, and at least one fastener.

In one embodiment, the golf club head having a hosel portion, wherein the hosel portion is provided with a cylindrical sleeve. In one embodiment, the hosel adapter is configured to insert into the hosel portion such that the hosel adapter is positioned within the cylindrical sleeve of the hosel portion. In one embodiment, the golf club shaft having a proximal end and a terminal end. In one embodiment, the shaft adapter is securely affixed to the terminal end of the golf club shaft, wherein the shaft adapter is configured to insert into the hosel adapter via a longitudinal bore.

In one embodiment, at least one fastener having a plurality of threads and slidably positioned onto the golf club shaft using an O-ring. In one embodiment, the fastener is configured to threadably engage to the hosel adapter via the plurality of threads, thereby securing the club head and the golf club shaft together by inserting the shaft adapter into the hosel adapter. In one embodiment, the user could mark on the golf club shaft for determining the golf club shaft insertion depth.

In one embodiment, the user could simply secure the golf club shaft to the club head using at least one fastener by tightening it using the tool, for example, a wrench. In one embodiment, the fastener is at least any one of, but not limited to, a nut and/or a bolt.

In one embodiment, the hosel adapter is securely and rotatably affixed to the hosel portion of the golf club head using an adhesive or glue. In one embodiment, the hosel portion of the golf club head could be drilled to form a cylindrical sleeve with a diameter for receiving the hosel adapter. In one embodiment, the hosel adapter having a longitudinal bore sized and configured to insert into the hosel portion such that the hosel adapter is positioned within the cylindrical sleeve of the hosel portion. In one embodiment, the hosel adapter further comprises a first anti-rotational member at the top portion, wherein the first anti-rotational member is in the form of a pair of cut outs.

In one embodiment, the shaft adapter is securely affixed to the terminal end of the golf club shaft using, but not limited to, an adhesive or glue. In one embodiment, the shaft adapter is securely affixed to the terminal end of the golf club shaft using an epoxy. In one embodiment, the shaft adapter having a bore sized and securely affixed to the terminal end of the golf club shaft. In one embodiment, the shaft adapter is configured to insert into the hosel adapter via the longitudinal bore. In one embodiment, the shaft adapter further comprises a second anti-rotational member, wherein the second anti-rotational member is in the form of a pair of keys.

In one embodiment, the hosel adapter and shaft adapter are further configured to rotatably affix relative to one another through engagement of the first and second anti-rotation members, respectively. In one embodiment, the fastener, for example, a nut and/or a bolt, is configured to threadably engage to the hosel adapter via the plurality of threads using at least one O-ring, thereby securing the club head and the golf club shaft together by inserting the shaft adapter into the hosel adapter.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Embodiments of the present invention include, but are not limited to the following detailed description of drawings. The included drawings show examples of the invention as a browser extension created, designed and/or coded to interact with the web forms of online sites, to copy data that has been previously entered and is now displayed on one web page or web form and paste this data into the appropriate fields of another website's online form, where data can include, but not be limited to, text, html markup or tags, images, videos, graphics, other types of files, and any other relevant data type as could be found online or entered into an online form.

Figure 1:
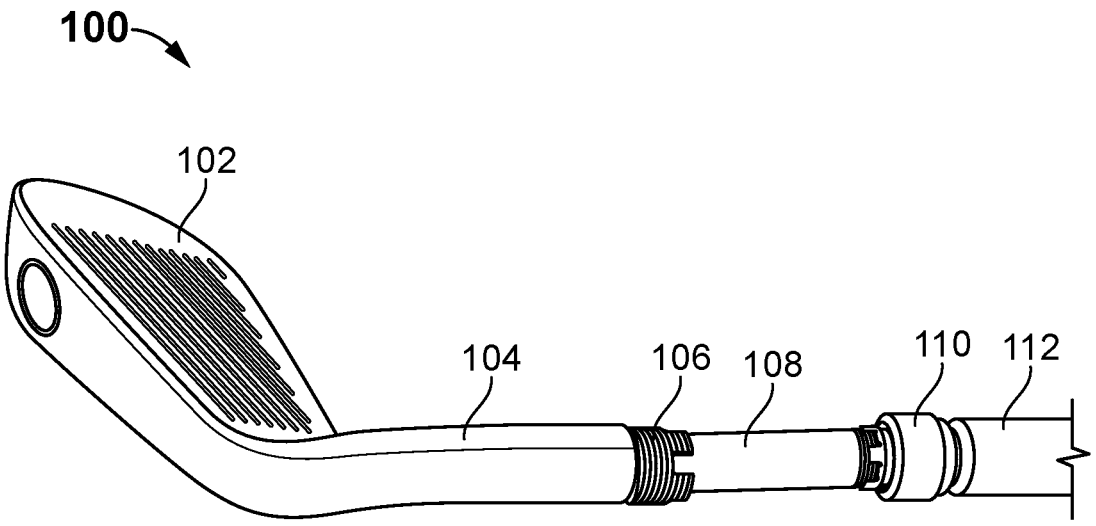
FIGS. 1-2 show perspective views of an apparatus used for securely connecting a golf club shaft to a golf club head having a hosel portion in an embodiment of the present invention.
Figure 2:
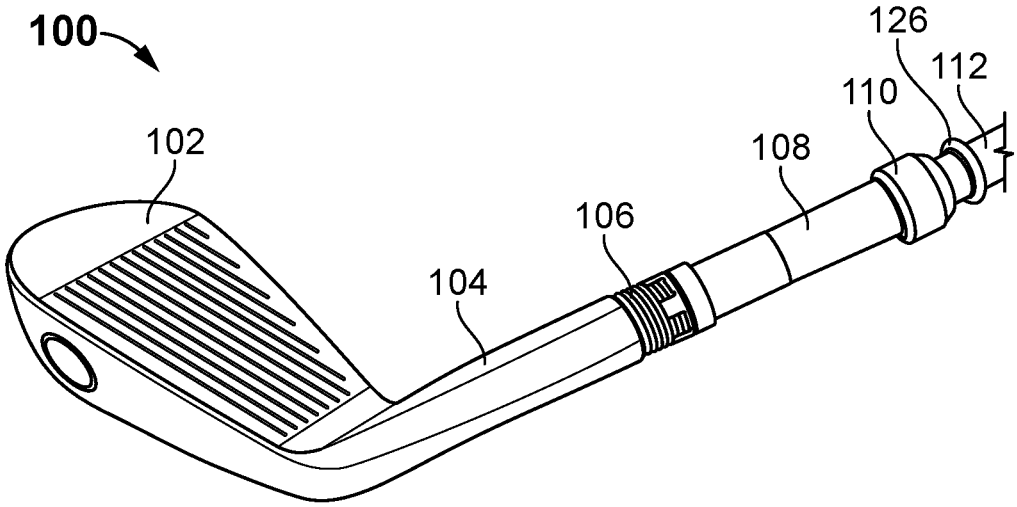

Referring to FIGS. 1-2, an apparatus 100 used for securely connecting a golf club shaft 112 to a golf club head 102 having a hosel portion 104. In one embodiment, the apparatus 100 is configured to enable a user to securely connect the golf club shaft 112 to the hosel portion 104 of the golf club. In one embodiment, the apparatus 100 could be advantageously employed with various types of golf clubs. In one embodiment, the apparatus 100 is configured to make a quick switch to combine/assemble different shafts and different clubs head, for a golfer to try if that setup is suitable for him. The switching could perform again and again without any damage and pull job and no extra glue is required. In one embodiment, the apparatus 100 is securely affixed between the golf club shaft 112 to the hosel portion 104 of the golf club without any modification of either of these components. In one embodiment, the apparatus 100 comprises a hosel adapter 106, a shaft adapter 108, and at least one fastener 110.

In one embodiment, the golf club head 102 having a hosel portion 104, wherein the hosel portion 104 is provided with a cylindrical sleeve 124. In one embodiment, the hosel adapter 106 is configured to insert into the hosel portion 104 such that the hosel adapter 106 is positioned within the cylindrical sleeve 124 of the hosel portion 104. In one embodiment, the golf club shaft 112 having a proximal end and a terminal end. In one embodiment, the shaft adapter 108 is securely affixed to the terminal end of the golf club shaft 112, wherein the shaft adapter 108 is configured to insert into the hosel adapter 106 via a longitudinal bore.

In one embodiment, at least one fastener 110 having a plurality of threads and slidably positioned onto the golf club shaft 112 using an O-ring 126. In one embodiment, the fastener 110 is configured to threadably engage to the hosel adapter 106 via the plurality of threads, thereby securing the club head 102 and the golf club shaft 112 together by inserting the shaft adapter 108 into the hosel adapter 106. In one embodiment, the user could mark on the golf club shaft 112 for determining the golf club shaft insertion depth.

Figure 3:
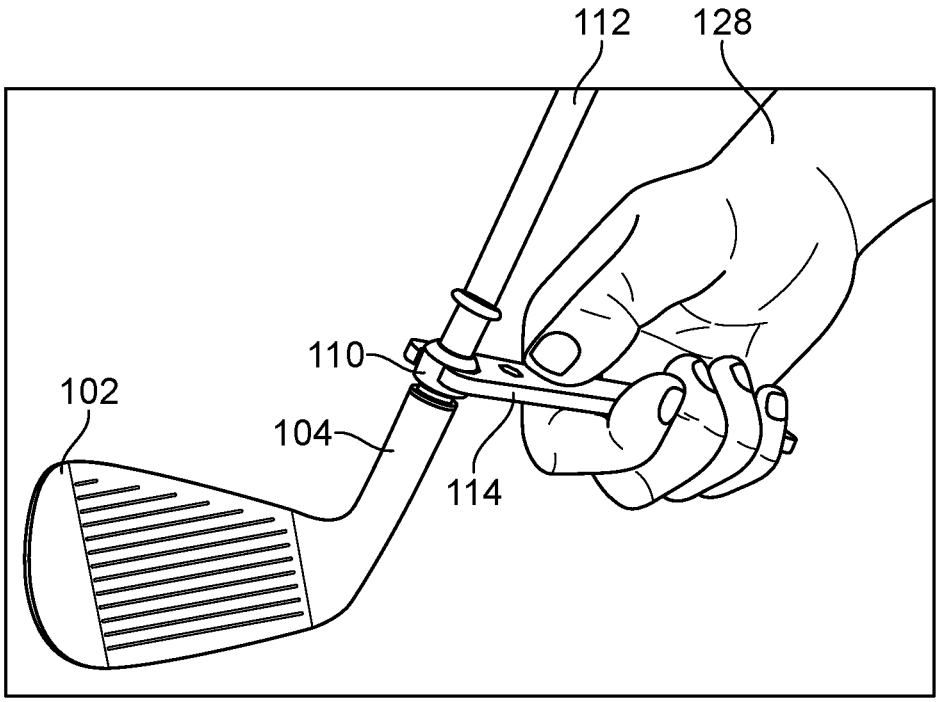
FIG. 3 shows a perspective view of a golf club shaft secured to the club head by the user using a tool in one embodiment of the present invention.

Referring to FIG. 3, the golf club shaft 112 secured to the club head 102 by the user 128 using a tool 114 in one embodiment is disclosed. In one embodiment, the user 128 could simply secure the golf club shaft 112 to the club head 102 using at least one fastener 110 by tightening it using the tool 114, for example, a wrench. In one embodiment, the fastener 110 is at least any one of, but not limited to, a nut and/or a bolt.

Figure 4:
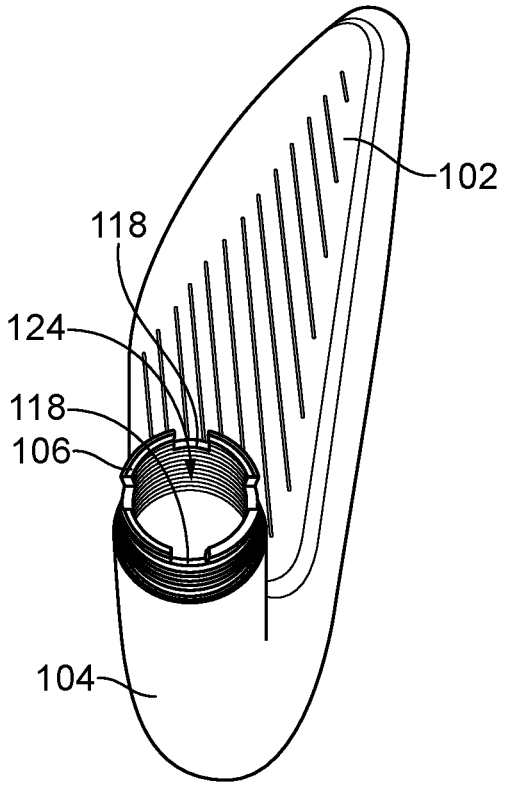
FIG. 4 shows a top perspective view of a hosel adapter affixed to the hosel portion of the golf club head in one embodiment of the present invention.

Referring to FIG. 4, a top perspective view of the hosel adapter 104 affixed to the hosel portion 104 of the golf club head 102 is one embodiment is disclosed. In one embodiment, the hosel adapter 104 is securely and rotatably affixed to the hosel portion 104 of the golf club head 102 using an adhesive or glue. In one embodiment, the hosel portion 104 of the golf club head 102 could be drilled to form a cylindrical sleeve 124 with a diameter for receiving the hosel adapter 106. In one embodiment, the hosel adapter 106 having a longitudinal bore 130 (shown in FIG. 8) sized and configured to insert into the hosel portion 104 such that the hosel adapter 106 is positioned within the cylindrical sleeve 124 of the hosel portion 104. In one embodiment, the hosel adapter 106 further comprises a first anti-rotational member 118 at the top portion, wherein the first anti-rotational member 118 is in the form of a pair of cut outs as shown in FIG. 4.

Figure 5:
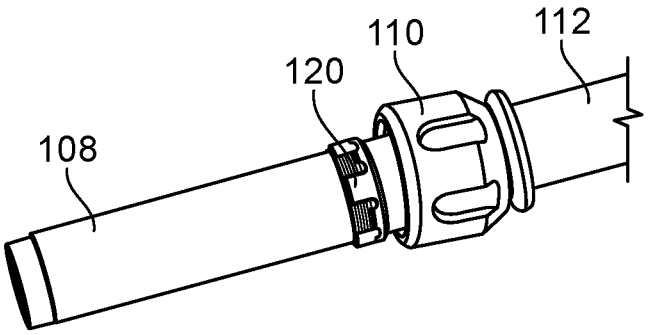
FIG. 5 shows a perspective view of a shaft adapter securely affixed to the golf club shaft in one embodiment of the present invention.

Referring to FIG. 5, the shaft adapter 108 securely affixed to the golf club shaft 112 in one embodiment is disclosed. In one embodiment, the shaft adapter 108 is securely affixed to the terminal end of the golf club shaft 112 using, but not limited to, an adhesive or glue. In one embodiment, the shaft adapter 108 is securely affixed to the terminal end of the golf club shaft 112 using an epoxy. In one embodiment, the shaft adapter 108 having a bore 132 (shown in FIG. 9) sized and securely affixed to the terminal end of the golf club shaft 112. In one embodiment, the shaft adapter 108 is configured to insert into the hosel adapter 106 via the longitudinal bore 130. In one embodiment, the shaft adapter 108 further comprises a second anti-rotational member 120, wherein the second anti-rotational member 120 is in the form of a pair of keys as shown in FIG. 5.

Figure 6:
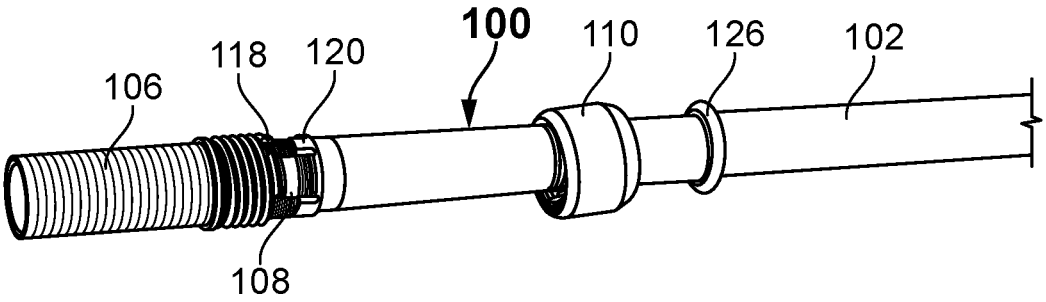
FIG. 6 shows a perspective view of the apparatus affixed to the golf club shaft in one embodiment of the present invention.
Figure 7:
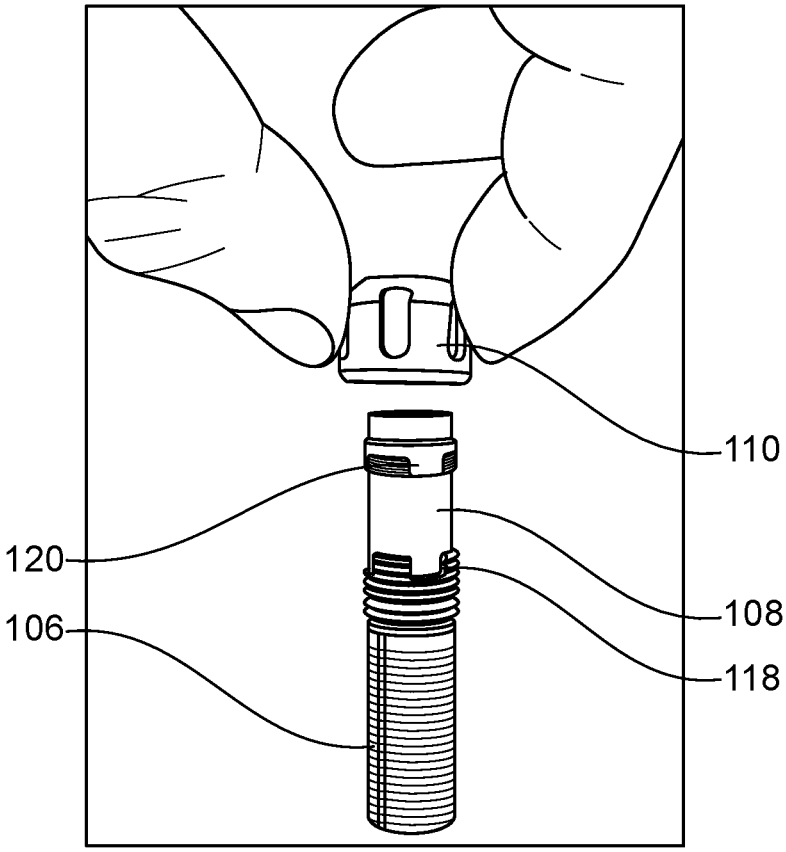
FIG. 7 shows a perspective view of the apparatus according to one embodiment of the present invention.

Referring to FIGS. 6-7, a perspective view of the apparatus 100 affixed to the golf club shaft 112 in one embodiment is disclosed. In one embodiment, the hosel adapter 106 and shaft adapter 108 are further configured to rotatably affix relative to one another through engagement of the first and second anti-rotation members (118 and 120), respectively. In one embodiment, the fastener 110, for example, a nut and/or a bolt, is configured to threadably engage to the hosel adapter 106 via the plurality of threads using at least one O-ring 126, thereby securing the club head 102 and the golf club shaft 112 together by inserting the shaft adapter 108 into the hosel adapter 106.

In one embodiment, the inner diameter of the hosel portion 104 is larger than the outer diameter of the hosel adapter 106. In one embodiment, the inner diameter of the hosel adapter 106 is larger than the outer diameter of the shaft adapter 108.

Figure 8:
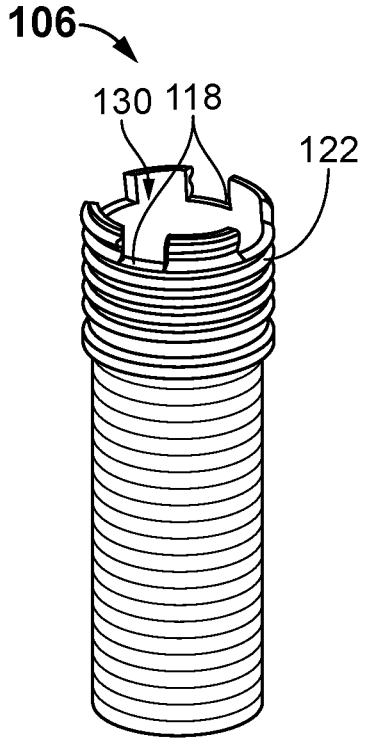
FIG. 8 shows a perspective view of the hosel adapter of the apparatus in one embodiment of the present invention.

Referring to FIG. 8, a perspective view of the hosel adapter 106 of the apparatus 100 in one embodiment is disclosed. In one embodiment, the hosel adapter 106 comprises a longitudinal bore 130 for receiving the shaft adapter 108. The hosel adapter 106 further comprises a plurality of threads 122 at a top portion for threadably securing the fastener 110, thereby securely holding the golf club shaft 112 to the hosel portion 104 of the golf club head 102. In one embodiment, the hosel adapter 106 further comprises a first anti-rotational member 118 at the top portion, wherein the first anti-rotational member 118 is in the form of a pair of cut outs. In one embodiment, the hosel adapter 106 could be made of a material, but not limited to, titanium. In one embodiment, the hosel adapter 106 has same depth as the actual (standard) built clubs.

Figure 9:
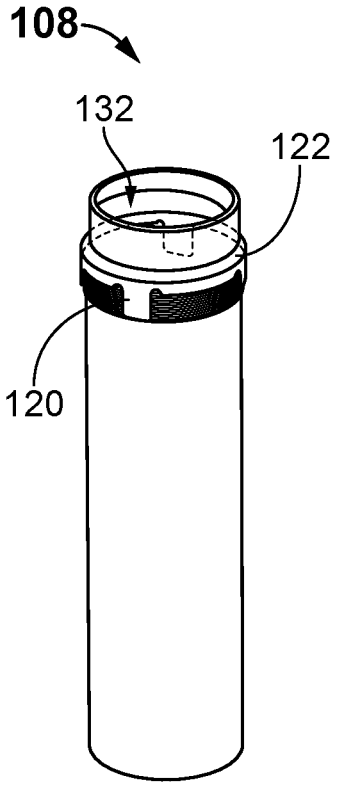
FIG. 9 shows a perspective view of the shaft adapter of the apparatus in one embodiment of the present invention.

Referring to FIG. 9, a perspective view of the shaft adapter 108 of the apparatus 100 in one embodiment is disclosed. In one embodiment, the shaft adapter 108 comprises a bore 132 sized and securely affixed to the terminal end of the golf club shaft 112 using an adhesive or glue. In one embodiment, the shaft adapter 108 is configured to insert into the hosel adapter 106 via the longitudinal bore 130. The shaft adapter 108 further comprises a second anti-rotational member 120, wherein the second anti-rotational member 120 is in the form of a pair of keys. In one embodiment, the second anti-rotational member 120 is formed and extended from a radial projection 122 of the shaft adapter 108. In one embodiment, the shaft adapter 108 is design with empty in the middle. By the design, the shaft 112 is actually put into the bottom of the club head hosel portion 104. The weights are reduced due to the drilling from the club head hosel portion 104 and it will balance the total weights of the demo to be same as the actual built clubs. It is invisible like the actual built clubs.

Figure 10:
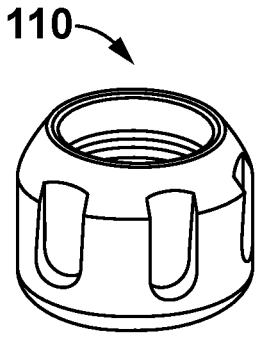
FIG. 10 shows a perspective view of a fastener, for example, a nut, of the apparatus in one embodiment of the present invention.

Referring to FIG. 10, a perspective view of the fastener 110, for example, a nut, in one embodiment is disclosed. In one embodiment, the fastener 110 is configured to threadably engage to the hosel adapter 106 via the plurality of threads 122, thereby securing the club head 102 and the golf club shaft 112 together.

Preferred embodiments of this invention are described herein, including the best mode known to the inventors for carrying out the invention. It should be understood that the illustrated embodiments are exemplary only and should not be taken as limiting the scope of the invention.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings in the foregoing descriptions. Although specific terms may be employed herein, they are used only in generic and descriptive sense and not for purposes of limitation. Accordingly, the present invention is not limited to the specific embodiments illustrated herein.

What is claimed is:

1. An apparatus for securely connecting a golf club shaft and a club head, comprising:

a golf club head having a hosel portion, wherein the hosel portion is provided with a cylindrical sleeve;

a hosel adapter having a longitudinal bore sized and configured to insert into the hosel portion such that the hosel adapter is positioned within the cylindrical sleeve of the hosel portion, wherein the hosel adapter further comprises a plurality of threads at a top portion, wherein the hosel adapter further comprises a first anti-rotational member at the top portion, wherein the first anti-rotational member is in the form of a pair of cut outs;

a golf club shaft having a proximal end and a terminal end;

a shaft adapter having a bore sized and securely affixed to the terminal end of the golf club shaft, wherein the shaft adapter is configured to insert into the hosel adapter via the longitudinal bore, wherein the shaft adapter further comprises a second anti-rotational member, wherein the second anti-rotational member is in the form of a pair of keys, and is formed and extended from a radial projection of the shaft adapter, and wherein the hosel adapter and shaft adapter are further configured to rotatably affix relative to one another through engagement of the first and second anti-rotation members, respectively;

at least one fastener having a plurality of threads and slidably positioned onto the golf club shaft using an O-ring, wherein the fastener is configured to threadably engage to the hosel adapter via the plurality of threads, thereby securing the club head and the golf club shaft together by inserting the shaft adapter into the hosel adapter.

2. The apparatus of claim 1, wherein the hosel adapter is securely and rotatably affixed to the hosel portion using an adhesive or glue.

3. The apparatus of claim 1, wherein the shaft adapter is securely affixed to the terminal end of the golf club shaft using an adhesive or glue.

4. The apparatus of claim 1, wherein the fastener is a nut and/or a bolt.

5. An apparatus for securely connecting a golf club shaft and a club head, comprising:

a golf club head having a hosel portion, wherein the hosel portion is provided with a cylindrical sleeve;

a hosel adapter having a longitudinal bore and a first anti-rotation member formed on a top portion of the longitudinal bore, wherein the hosel adapter is configured to insert into the hosel portion such that the hosel adapter is positioned within the cylindrical sleeve of the hosel portion, wherein the hosel adapter further comprises a plurality of threads at a top portion;

a golf club shaft having a proximal end and a terminal end;

a shaft adapter having an annular wall and a second anti-rotation member formed on the annular wall, wherein the shaft adapter is configured to insert into the hosel adapter via the longitudinal bore, wherein the hosel adapter and shaft adapter are further configured to rotatably affix relative to one another through engagement of the first and second anti-rotation members, respectively, and a fastener having a plurality of threads and slidably positioned onto the golf club shaft using an O-ring, wherein the fastener is configured to threadably engage to the hosel adapter via the plurality of threads, thereby securing the club head and the golf club shaft together by inserting the shaft adapter into the hosel adapter.

6. The apparatus of claim 5, wherein the first and second anti-rotation members are configured to mate to secure the club head and the golf club shaft together using the fastener.

7. The apparatus of claim 5, wherein the hosel adapter is securely fixed to the hosel portion using an adhesive or glue.

8. The apparatus of claim 5, wherein the first anti-rotational member of the hosel adapter are is in the form of a pair of cut outs.

9. The apparatus of claim 5, wherein the shaft adapter is securely affixed to the terminal end of the golf club shaft using an adhesive or glue.

10. The apparatus of claim 5, wherein the second anti-rotational member of the shaft adapter are in the form of a pair of keys.

11. The apparatus of claim 5, wherein the fastener is a nut and/or a bolt.

* * * * *